US008720135B2

(12) United States Patent
Sønderkær et al.

(10) Patent No.: US 8,720,135 B2
(45) Date of Patent: May 13, 2014

(54) WINDOW COMPRISING A BORDERED PANE MODULE

(75) Inventors: Peter Sønderkær, Horsens (DK); Kristian Ørnsvig Nielsen, Hornsyld (DK); Lars Kristensen, Østbirk (DK)

(73) Assignee: VKR Holding A/S (DK)

( * ) Notice: Subject to any disclaimer, the term of this patent is extended or adjusted under 35 U.S.C. 154(b) by 267 days.

(21) Appl. No.: 12/733,003

(22) PCT Filed: Jul. 31, 2008

(86) PCT No.: PCT/DK2008/050185

§ 371 (c)(1),
(2), (4) Date: Apr. 21, 2010

(87) PCT Pub. No.: WO2009/018826

PCT Pub. Date: Feb. 12, 2009

(65) Prior Publication Data

US 2010/0205879 A1 Aug. 19, 2010

(30) Foreign Application Priority Data

Aug. 3, 2007 (DK) ..... 2007 01122

(51) Int. Cl.
*E06B 3/54* (2006.01)

(52) U.S. Cl.
CPC ..... *E06B 3/54* (2013.01)
USPC ..... 52/204.55; 52/208; 52/204.593; 52/204.6; 52/745.15

(58) Field of Classification Search
USPC ..... 52/79.9, 79.11, 79.12, 204.55, 208, 52/235, 745.1, 200, 204.593, 204.6, 52/745.15, 745.16
See application file for complete search history.

(56) References Cited

U.S. PATENT DOCUMENTS

| | | | | | |
|---|---|---|---|---|---|
| 1,301,737 | A * | 4/1919 | Pierce | 52/208 |
| 1,947,736 | A * | 2/1934 | Potter | 52/208 |
| 1,961,352 | A * | 6/1934 | Hall | 52/208 |
| 2,866,527 | A * | 12/1958 | Schilling | 52/235 |
| 3,665,661 | A * | 5/1972 | Beckerer | 52/200 |
| 4,570,399 | A * | 2/1986 | Wentink | 52/208 |
| 5,061,531 | A * | 10/1991 | Catalano | 52/786.13 |
| 6,216,417 | B1 * | 4/2001 | Morin et al. | 52/208 |

FOREIGN PATENT DOCUMENTS

| | | |
|---|---|---|
| DE | 9110698 U1 | 1/1992 |
| DE | 19642175 A1 | 4/1998 |
| EP | 0384462 | 8/1990 |
| EP | 1136644 A2 | 9/2001 |
| FR | 1381137 | 12/1964 |
| FR | 2514057 | 4/1983 |

* cited by examiner

*Primary Examiner* — Mark Wendell
*Assistant Examiner* — Matthew J Smith
(74) *Attorney, Agent, or Firm* — Merek, Blackmon & Voorhees, LLC

(57) ABSTRACT

The pane module is composed by a border element (2) molded around the pane element (1) encasing it on the edge and interior faces. The frame may be of a rectangular configuration, but it is to be understood that more complex configurations may be necessary for achieving a water proof connection to the structure in which the window is mounted or to a surrounding window frame. A fitting (42) is embedded in the border element (2) during its manufacture and is subsequently or simultaneously connected to the frame (3). When using a wooden or extruded frame the fitting may be driven into the finished frame member and when using a molded frame the fitting may be embedded therein during molding.

7 Claims, 2 Drawing Sheets

WINDOW COMPRISING A BORDERED PANE MODULE

CROSS-REFERENCE TO RELATED APPLICATION

Figure 1:
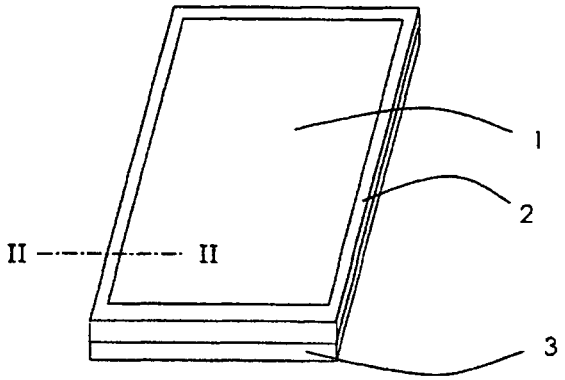

The present application claims the priority under 35 U.S.C. 119 of Danish Application No. PA 2007 01122, filed Aug. 3, 2007, which is hereby incorporated herein by reference in its entirety.

The invention relates to a method for making a window for a building comprising a frame and a pane with at least two sheet elements, such as sheets of glass, separated by one or more spacer members. The invention further relates to a window made by the method and being intended for use in residential, office or industrial buildings.

When glazing vertical windows as well as roof windows the pane is usually secured to a glass-carrying frame, i.e. traditionally the sash, by means of glazing profiles fastened to the frame by means of screws. The pane is kept in place by means of glass spacers and glazing clips. Though it has proven very efficient this method suffers from a number of disadvantages, among others the large number of different parts needed for the glazing and the fact that the discontinuous support may cause potentially destructive strains on the pane, particularly when using a conventional glass sheet pane. This influences the lifespan of the pane with respect to breakage and failure in the sealing, the latter resulting in the formation of condensation in the space between the two sheets of glass constituting the pane.

More recently, attempts have also been made to attach the pane to the frame by means of gluing. This has provided a continuous support for the pane, enabling it to carry a larger share of the loads inflicted by wind and other weather-related factors. This, in turn, allows the use of more slender frame profiles with reduced weight and the design of the frame profiles may be dedicated to the achievement of improved insulation properties. Last but not least, the slimmer frame structures allow an increase of the pane area, increasing the ingress of light and thereby the utilization of the free heating of the sun.

In recent years the technology of gluing has developed into a realistic alternative to a conventional glazing of a pane module, as it is now possible to make a glued connection, which has a good resistance to dynamical loads, heat, UV and even moisture. Gluing has for example been used in the so-called "instant glazing" technique, where adhesive replace sealing and rubber gaskets, and pane modules have been glued to the sash or glazing profile to obtain a structural connection between pane and sash or frame.

Gluing technology has, however, not penetrated the large volume market for windows and the application in fenestration and glazing still has several unsolved problems. For instance, a satisfactory solution to the problem of securing the pane in the event of adhesion failure has not been provided, and design criteria relating to strength and mechanical properties of the glue are also lacking. Moreover, the quality of the glued connection is sensitive to the environment at the location where the gluing is performed, to the preparation of the adhesion surfaces etc. and the employees performing the gluing must therefore be specially trained. This entails the necessity of large investments in climatic control, quality control systems and staff training. Standards for pane and window design criteria's have not yet been provided.

It is therefore the object of the invention to provide a method for making a window, where the pane may be attached to the frame in a secure and durable manner and with the use of fewer parts than what is needed for conventional glazing.

This is achieved by a method, where the pane is provided with a border element and where the border element is attached to the frame. By attaching the pane to a border element a continuous support along the entire edge of the pane in achieved, but without the need for glue. There is thus no need for glazing clips etc. and the fact that the border of the pane is protected by the border element makes the mounting process less delicate.

In this, the term "frame" covers both stationary and moveable frames including traditional sashes. Furthermore, the term includes such elements, which includes other elements as well, and the method may be used in glazing any type of window regardless of the number of frames etc. Similarly the method may be used regardless of the shape of the pane and any type of pane, such as thermo panes, vacuum panes and step unit panes, may be used, including panes with three or more sheet elements.

The border element is preferably made by moulding, where edges of at least one sheet element are encased during the moulding process. The term "encase" should not be understood as if the border element encloses or embraces the entire edge of the pane; the mere contact between surfaces of the border element and pane may give a sufficient attachment. Similarly it is not necessary that all four edges of a sheet element is encased as long as the pane as a whole is sufficiently retained. The border element may also adhere to spacer members, sealings and the like.

The connection between the border element and the frame may be achieved in numerous ways including the use of nails, screws, truss plates, glue, adhesives, click-on systems etc.

If employing a releasable mode of attachment it will easy to replace a broken pane and in addition it will be possible to provide a pick-and-click system, where any particular demand as regards colour, insulation properties, sound dampening etc., may be met by choosing between different types border elements.

A particularly good connection may, however, be achieved by embedding a fitting in the border element during the moulding process and using this fitting for the attachment to the frame. If using a frame of a mouldable material, such as plastic or aluminium, the other end of the fitting may be embedded therein. The moulding of the frame may then be performed before, simultaneously or after moulding of the border element.

A sufficient connection between the border element and a moulded frame may, however, also be achieved solely be the adhesion between the moulding materials used. In this case it may be particularly advantageous to mould the two simultaneously or shortly after one another. If moulding the two parts one after another the adhesion may be promoted by priming the surface of the part, which is moulded first.

For the purpose of keeping the border element and the frame in the right position in relation to each other they may advantageously be provided with matching projections and depressions, a projection on one part fitting into a depression on the other when the two parts are positioned correctly. The matching projections and depressions increased the shear strength of the connection.

The border element and/or the frame may be composed of a number of members with different configurations. Typically the bottom member has to be able to allow rain water and the like to drain off, whereas the top and side members should keep the water for penetrating into the surrounding structure.

Figure 2A:
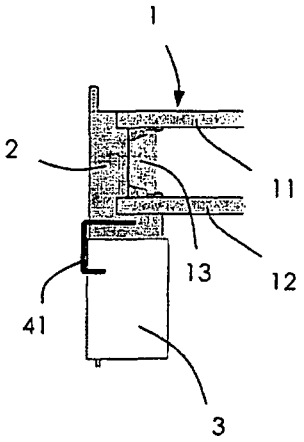
Figure 2B:
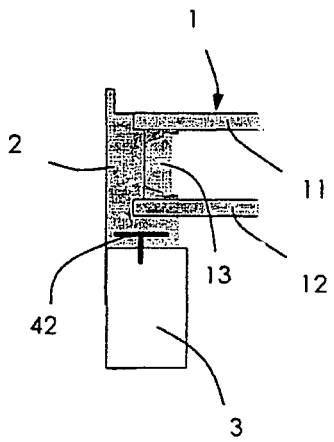
Figure 3:
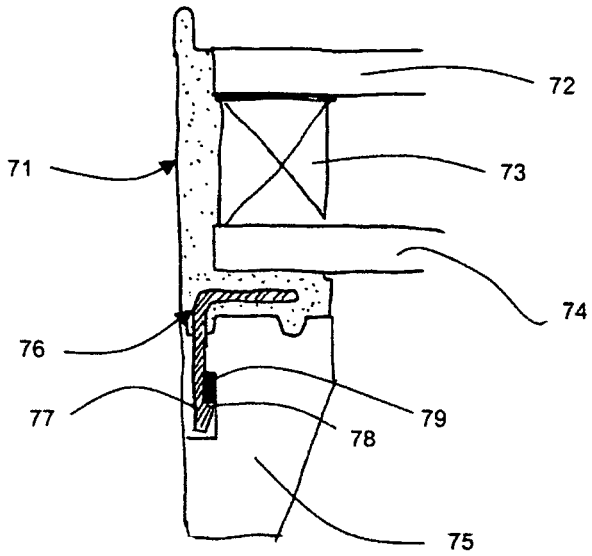
Figure 4:
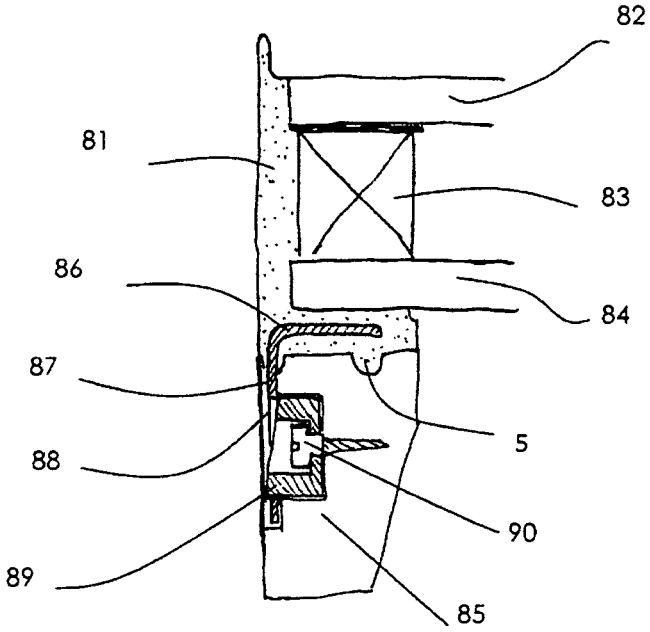

The moulding of the border element and/or frame is preferably performed by reaction injection moulding (RIM) or low pressure moulding. Thermoplastics such as polyurethane or polyolefin are preferred moulding materials, but others thermoplastic materials such as PVC, PE or PP, a thermoplastic elastomeric (TPE) or thermoset elastomer materials such as EPDM may also be used. In the following, the invention will be described in further detail with reference to the drawing in which:

FIG. 1 is a perspective view of a window made according to the invention,

FIGS. 2*a* and 2*b* are cross sectional views taken along the line II-II in FIG. 1 and showing the integration of the frame in the border element, FIG. 3 is a cross sectional view corresponding to the ones in FIGS. 2*a* and 2*b* and showing the attachment of the border element to the frame by means of a click-on system, and FIG. 4 is a cross sectional view corresponding to the one in FIG. 3 and showing the attachment of the border element to the frame by means of a fitting attached to the frame with screws.

A window made according to the invention is shown in FIG. 1. It may be made with the features necessary for installation vertically or inclined in the facade or the roof of any residential, office or industrial building. It comprises a pane element 1 (referred to as pane in the following), a border element 2 and a frame 3. In this embodiment the frame is stationary, but it is to be understood that the pane and border element could also be mounted on a moveable frame, also known as a sash, mounted in the stationary frame.

The main function of the border element 2 is to create a structural joint between the pane 1 and the frame 3, thereby rendering the glazing profiles etc. formerly used redundant. It may additionally take over some of the functions formerly seated in the frame such as the bearing of sun screening devices.

In the embodiment shown, the border element 2 surrounds the entire border of the pane element, but it is to be understood that it may also be U-shaped surrounding the pane on three of its four sides or that separate elements may be used on each side leaving the corners of the pane free. Similarly it is to be understood that windows with other geometrical configurations, i.e. semi-circular or triangular, are also conceivable.

The border element 2 is preferably made by moulding it directly on the pane. Polyurethane is a preferred moulding material.

The pane module consisting of the pane 1 and the border element 2 may function as a structural element contributing to bearing the loads affecting the window. The frame 3 may therefore be more slender than what those used in a conventional window. Any suitable material, such as wood, plastic, polyurethane or polyurethane with a wooden core, can be used for the manufacture of the frame.

The border element and possibly also the frame may be produced by using any suitable moulding technique, but injection moulding, e.g. reaction injection moulding (RIM), is preferred. When using the RIM process, current-carrying components, plastic or metal components contributing to strength and stiffness, screws etc. may be embedded in the moulding material. Furthermore, the RIM process allows the integration of details such as sealings.

Reaction injection moulding (RIM) is a process that is well known per se. During moulding, a two-component curing polyurethane is mixed in the mould. In the mould a pressure of approximately 6 to 10 bar is obtained during the curing process. The cured item is ready to be handled within approximately 45 to 60 seconds. During the RIM process itself the temperature of the material and the mould lies between 80 and 110° C. depending on the configuration of the mould and whether the polyurethane used is of the aromatic or the aliphatic kind. According to the kind of polyurethane used different Shore A hardness may be obtained. In the example, polyurethane having a cured hardness of 60-90 Shore A may be used.

It is of course also possible to perform the moulding in other ways, e.g. at higher temperature and/or pressure, which may be necessary when using other materials than polyurethane. Using a single-component material, which is injected into the mould without the need for mixing is another option.

The pane element is usually composed of monolithic glass elements. In this context the term "monolithic glass" covers annealed glass, tempered glass, laminated glass, wired glass, figured or patterned glass as well as other types of glass that are used in conventional panes. Even if referred to as being made from glass, it is to be understood that Plexiglas (also known as Perspex) or any other sheet element, transparent or not, which is suited for the particular use of the window, may also be employed, including luminescent materials. The glass may have coatings on one or both sides.

The cavity between the sheet elements may be filled with dry air, gas such as Ar, Kr or Xe, or with gas mixtures suitable for improving the insulating properties of the pane by reducing its U value. A vacuum pane may also be used as may a pane with a layer of aerogel filling the space between the sheet elements.

The pane element may be a conventional type pane, where all sheet elements have identical size and shape, or may be a step unit. Step units are panes, where the different glass sheets have different height and/or width so that one sheet projects over another at least at one edge thereof. Also panes comprising three or more sheet elements, such as for example three-sheet thermo panes, may be used as may combinations of different pane types such as a traditional thermo pane in combination with a single sheet pane.

If using a pane type that can best be made in relatively small units, such as vacuum panes, a series of pane elements may be arranged side-by-side for the formation of a larger element of the desired size. This method may also be used for providing different areas of the pane with different properties such as colour, opacity, insulation etc.

The distance profiles or spacer members may be made from metal or plastic. A desiccant may be deposited in hollow distance profiles, embedded in a matrix or in a getter element in each of the cavities delimited by the glass sheets and the distance profiles. This may be done as a part of the pane module manufacture or the different elements may be pre-manufactured. Moreover, the distance profile may be provided with additional functionalities, such as sound dampening features, or additional members providing such functionalities may be provided in between the sheet elements of the pane(s).

The pane elements may be conventional type panes, where all glass sheets have identical size and shape, or may be step units. Step units are panes, where the different glass sheets have different height and/or width so that one sheet projects over another at least at one edge thereof.

A two-sheet pane may be constructed simultaneously with the moulding of the border element, in which case the distance profile 13,73,83 may be made as an integral part of the border element. The same applies if combining different pane types such as a two-sheet pane with a single-sheet pane; the two-sheet pane may then for example be made in a traditional manner whereas the distance member keeping it apart from the single-sheet pane may be a moulded projection on the border element. Either type of distance profile may be provided with projecting fittings or other means of attachment to the border element.

The connection between the pane and the border element is preferably achieved by the border element adhering to edges of the pane as will described later.

Though not connected directly, the frame may be in contact with the pane e.g. closing a space between the interior glass sheet and the border element. Gaskets may be provided for preventing damaging friction between the frame and the pane.

FIG. 2 shows two different embodiments of the side members of the border element 2 and frame 3 in a cross sectional view. As may be seen, the border element is moulded around the pane 1 encasing it on the edge and interior faces. The frame is shown as being of a rectangular configuration, but it is to be understood that more complex configurations may be necessary for achieving a water proof connection to the structure in which the window is mounted or to a surrounding window frame.

A fitting 41, 42 is embedded in the border element 2 during its manufacture and is subsequently or simultaneously connected to the frame 3. When using a wooden or extruded frame the fitting may be driven into the finished frame member and when using a moulded frame the fitting may be embedded therein during moulding. In the latter case an I-shaped fitting (not shown) may be used to thereby increase the draw out resistance.

If the adhesion of the border element 2 to the frame 3 is particularly strong and stable and the fitting 41, 42 may be left out entirely. This may be achieved by an appropriate priming of the area of attachment on the frame.

An example of a suitable primer is Carlofon Schwarz-primer EFTEC DV 990, but other products/materials may also be used.

The use of a moulded frame provides a particularly secure connection, but it necessitates the use of a mould that is big enough to hold both the frame and the pane element. Furthermore, it prevents subsequent detachment of the bordered pane module, meaning that the en-tire frame must be replaced if the pane is broken. This is of cause a source of additional cost, but may in return be done by persons that are not specially trained for the purpose.

FIG. 2 shows conventional type thermo panes, but other types of panes such as step unit panes or the combination of different pane types may also be used.

Attachment of the border element to the glass sheet elements 11, 12 is achieved purely by the adhesive properties of the moulding material and is established during the moulding process. To achieve good adhesion, the areas of attachment on the pane may be covered by a mask and/or be primed. The masking has the further purpose of contributing to the aesthetic value of the window and to protect adherends and the pane sealing 13 from sunlight. The mask is generally light-proof but must as a minimum be non-transparent for UV-A and UV-B light. The mask may be a ceramic coating, UV hardening lacquer, a one- or two-component lacquer or any other suitable material. It is to be understood that priming and masking may be achieved in one by the use of a material having properties suitable for both purposes.

Instead of the connection by moulding described above the border element may be connected to the frame by means of any detachable or undetachable connecting means. Examples of detachable connecting means are screws, nails or other mechanical connection means, e.g. a click-system. Examples of undetachable connecting means are glue or adhesives. Examples of click systems are shown in FIGS. 3 and 4.

In FIG. 3 the border element 71 encases the exterior glass sheet 72, the distance profile and pane sealing 73, as well as the interior glass sheet 74. A fitting 76 embedded in the border element 71 has a tongue 77 with a barb 78, which engages with a catcher 79 on the frame 75. As in the above embodiment and the embodiments to be described in the following the pane element includes glass sheets, which may be parallel or non-parallel plane sheets, or sheets having an arbitrary shape.

The system depicted in FIG. 4 corresponds to the one in FIG. 3 as regards the overall configuration of the pane, border element, fitting and frame. The border element 81 encases the exterior glass sheet 82, the distance profile and pane sealing 83, as well as the interior glass sheet 84. In this case, however, the frame 85 is provided with a fixation bushing 89 arranged to engage with a hole 88 in the projecting part 87 of the fitting 86. By turning the fixation bushing over 180 degrees, the tongue is engaged or disengaged. A screw 90 is used for fastening the bushing 89 in the frame element upon engagement of the tongue.

The connection between the border element and the frame is made in a manner that creates a watertight connection or at least so that moisture and water may be drained off in a controlled manner.

The surface of the border element, which is in contact with the frame is provided with a bead 5, which fits with a groove in the frame. The bead and groove not only serves as a guide for the positioning of the border and frame elements in relation to each other, but also contributes to the shearing strength of the joint.

Releasable connections of the types described above have the advantage of allowing the pane module consisting of the border element and the pane to be replaced. This not only allows the replacement of broken panes, but has much wider implications: An existing building may for example be given a new look by replacing the pane modules with ones of different appearance or the insulating properties of a building may be improved by replacing pane modules comprising older type panes with new ones having better properties.

Moreover, the frames and pane modules can be manufactured and stored separately and then be interconnected once the requirements for a given window has been established. In this way windows may effectively be custom made from a pick-and-click system of different components.

As described above, fittings may advantageously be used for the interconnection of the different parts of the window, but they may also serve other purposes. They may for example be used as strengthening and/or stiffening means, hinges, locking assemblies, reception means for receiving screws and other fastening means, current carriers, holders for claddings and/or coverings etc.

Further functionalities may be provided inside the border element. An example (not shown) of this is the provision of a current-carrying component providing an electrical connection between a solar energy collector in the pane element and an electrical window openers, a roller shutter, a light source, a display showing meteorological information, sensors controlling ventilation or the like. Other examples (not shown) are the provision of optical fibres or a passage for a curtain cord.

An embedded member or one of the fittings 41,42,76,86 may also be used for providing a pre-stressing of the border element, which may counteract harmful stresses on the pane caused by wind suction. Such influences are particularly pronounced with roof windows mounted in inclined roof surfaces and in the case of centre-hung windows primarily affect the lowermost half of the pane, which is being dragged outwards and upwards. This causes compressive stresses on the pane, which may eventually cause it to break. By embedding a tensioned cable or fitting wholly or partially in the material of the border element during moulding, a compressive force corresponding to the force of the tensioning will be applied to the material of the border element. Only wind forces, which are greater than the force of the tensioning, will thus cause stresses on the pane. The pre-stressing of the border element can of course be applied to the entire border element, but can also be limited to those border members, where it is most needed. As will be apparent to those skilled in the art, the pre-stressing may also be achieved in other ways, e.g. by applying a pre-stressed member (not shown) at level with or above the outer surface of the pane. A similarly effect could also be achieved by locally increasing the stiffness of the material of the border element, thus not actually causing a pre-stressing but instead increasing its resistance to bending.

In the above, the pane module has been described as either constituting a sash in itself or as constituting an element to be coupled to a further element to constitute a sash, in the sense that the sash is openable. The sash could also be fixed, i.e. not openable in the traditional sense but connected to a traditional frame. Furthermore, it would be possible to integrate the sash and the frame into a single element, or to form the sash as a traditional window frame for connection to the roof structure. All of these interpretation could be applied to the term "frame" within the context of the present application.

Furthermore, it is conceivable to make use of other configurations of the pane element. For instance, there may be more than two sheets of glass, and the sheets need not to be plane and/or parallel with each other. A further alternative conception lies in the possibility of applying at least some of the principles underlying the present invention to pane modules including a single sheet of glass.

In general, the features of the embodiments shown and described may be combined freely and no feature should be seen as essential unless stated in the claims.

The invention claimed is:

1. A method for making a window for a building comprising a stationary frame, a movable frame having a pane with at least two sheet elements separated by one or more spacer members and connected to the stationary frame, characterized in that the pane is provided with a border element and that the border element is attached to the movable frame, that the border element is made by a moulding process and that edges of at least one sheet element are encased in the border element during the moulding process, that the border element and the movable frame are provided with matching projections and depressions, that a fitting is embedded in the border element during the moulding process, and that the fitting is used for the attachment to the movable frame by forming a releasable connection therewith.

2. The method of claim 1, characterized in that both the border element and the frame are made by moulding.

3. The method of claim 2, wherein reaction injection moulding (RIM) or low pressure moulding is used for the moulding process(es).

4. The method of claim 1, characterized in that the border element and/or the frame is composed of a number of members with different configurations.

5. The method of claim 1, wherein the sheet elements are sheets of glass.

6. A window for a building comprising a stationary frame, a movable frame having a pane with at least two sheet elements separated by one or more spacer members and connected to the stationary frame, characterized in that the pane is attached to a border element, that the border element is connected to the movable frame, that the border element is made by moulding, and that edges of at least one sheet element are encased in the border element, that the border element and the movable frame have matching projections and depressions, that a fitting is embedded in the border element, and that the fitting is in releasable connection with the movable frame.

7. The method of claim 6, wherein the sheet elements are sheets of glass.

* * * * *